United States Patent [19]

Heiman

[11] Patent Number: 4,726,400

[45] Date of Patent: Feb. 23, 1988

[54] TERRY-TYPE CLOTH PRODUCT AND METHOD OF MAKING SAME

[75] Inventor: Gary L. Heiman, Maineville, Ohio

[73] Assignee: Standard Textile Company, Inc., Cincinnati, Ohio

[21] Appl. No.: 911,900

[22] Filed: Sep. 25, 1986

[51] Int. Cl.[4] ..... D03D 27/08

[52] U.S. Cl. ..... 139/396

[58] Field of Search ..... 112/410, 411, 426; 139/24, 25, 26, 391, 393, 395, 396

[56] References Cited

U.S. PATENT DOCUMENTS

| | | | |
|---|---|---|---|
| 1,665,274 | 4/1928 | Neisler | 139/25 |
| 1,949,579 | 3/1934 | Parker | 139/396 |
| 2,997,074 | 8/1961 | Law | 139/396 |
| 3,302,665 | 2/1967 | McHargue | 139/25 |

*Primary Examiner*—Henry S. Jaudon

*Attorney, Agent, or Firm*—Kinney & Schenk

[57] ABSTRACT

A terry-type cloth product and method of making same are provided wherein such product comprises ground fill and ground warp interlaced to define ground of the product, with the ground having a top surface and a bottom surface and pile warp extending from the ground and with the pile warp comprising a plurality of sets of pile yarns with each set of pile yarns having a plurality of pile yarns wherein the pile yarns of each set extend in a plurality of adjacent loops above the top surface and then pass through the ground and extend in a plurality of adjacent loops beneath the bottom surface and wherein the pile yarns of each set again pass through the ground and repeat in adjacent loops above the top surface and beneath the bottom surface across a dimension of the product, with each immediately adjacent pair of sets of yarns being staggered so as to provide a checkered pattern defined by sets of pile yarns and ground on each of the top and bottom surfaces.

20 Claims, 11 Drawing Figures

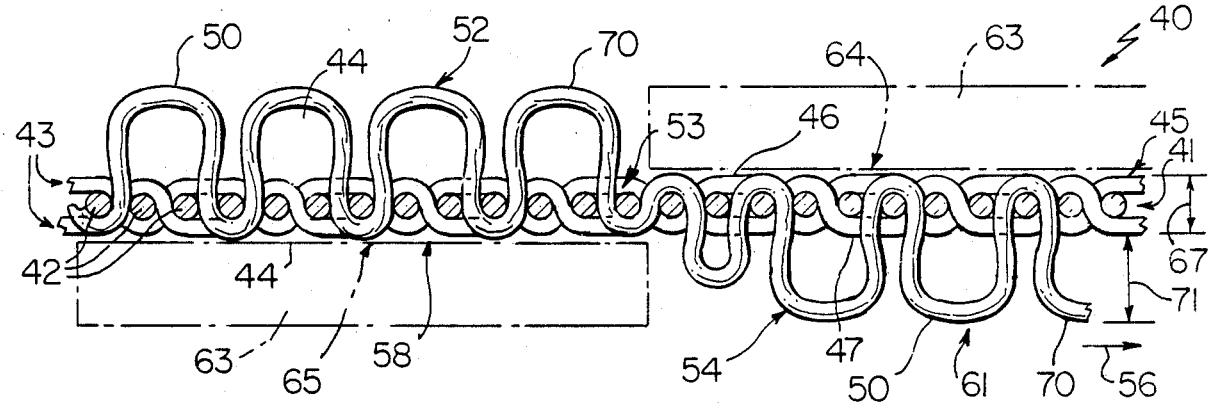
FIG. 4
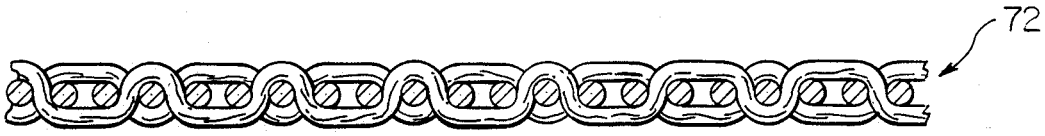
FIG. 5
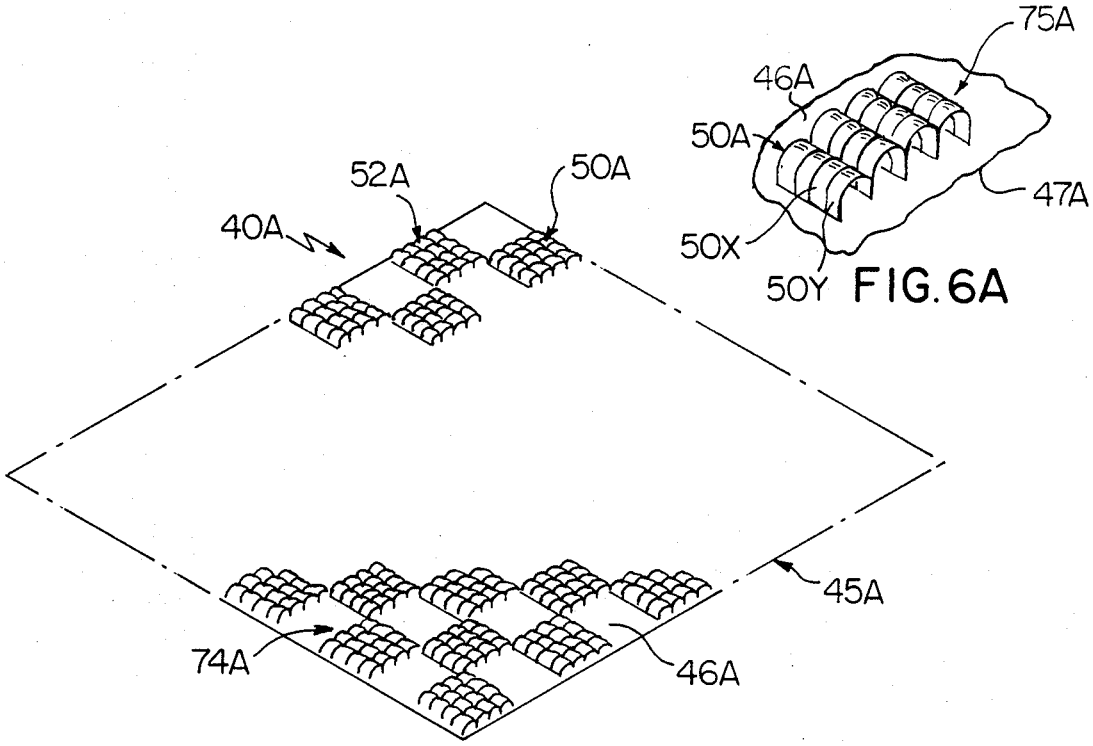
FIG. 6A
FIG. 6

TERRY-TYPE CLOTH PRODUCT AND METHOD OF MAKING SAME

BACKGROUND OF THE INVENTION

1. Field of the Invention

This invention relates to a terry-type cloth product and method of making such cloth product wherein the cloth product is preferably in the form of a bedspread of the type having particular application in a hospital, nursing home, or the like; and, such cloth product may also be used to make articles of clothing, towels of all types, bibs, and like items and particularly where it is desired to have a cloth product which provides thermal insulation.

2. Prior Art Statement

It is known in the art to provide a terry-type cloth product and method of making the same wherein such cloth product comprises ground fill and ground warp interlaced to define ground of the product and with the ground having a top surface and a bottom surface, and pile warp extending from the ground with the pile warp comprising a plurality of sets of pile yarns with each set of pile yarns having a plurality of pile yarns.

SUMMARY OF THE INVENTION

One feature of this invention is to provide a new terry-type cloth product comprising ground fill and ground warp interlaced to define ground of the product and with the ground having a top surface and a bottom surface and pile warp extending from the ground with the pile warp comprising a plurality of sets of pile yarns with each set of pile yarns having a plurality of pile yarns.

In accordance with one embodiment of the cloth product of this invention the pile yarns of each set extend in a plurality of adjacent loops above the top surface and then pass through the ground and extend in a plurality of adjacent loops beneath the bottom surface and the pile yarns of each set again pass through the ground and repeat in adjacent loops above the top surface and beneath the bottom surface across a dimension of the product, and each immediately adjacent pair of sets of yarns is staggered so as to provide a checkered pattern defined by sets of pile yarns and ground on each of the top and bottom surfaces.

Accordingly, it is an object of this invention to provide a new terry-type cloth product having one or more of the novel features of this invention as set forth above or hereinafter shown or described.

Another object of this invention is to provide a new method of making such a terry-type cloth product with the method of this invention having one or more of the novel features of this invention as set forth above or hereinafter shown or described.

Other features, objects, uses, and advantages of this invention are apparent from a reading of this description which proceeds with reference to the accompanying drawings forming a part thereof.

BRIEF DESCRIPTION OF THE DRAWINGS

The accompanying drawings show present preferred embodiments of this invention, in which

FIG. 4 is a view similar to FIG. 2 and taken essentially on the line 4—4 of FIG. 3;

FIG. 5 is a view similar to FIG. 4 illustrating a typical border of the product of FIG. 3;

FIG. 6 is a view similar to FIG. 3 illustrating another exemplary embodiment of the cloth product of this invention;

FIG. 6A is an enlarged view similar to FIG. 3A of a typical pile yarn of FIG. 6;

DESCRIPTION OF PREFERRED EMBODIMENTS

Figure 1:
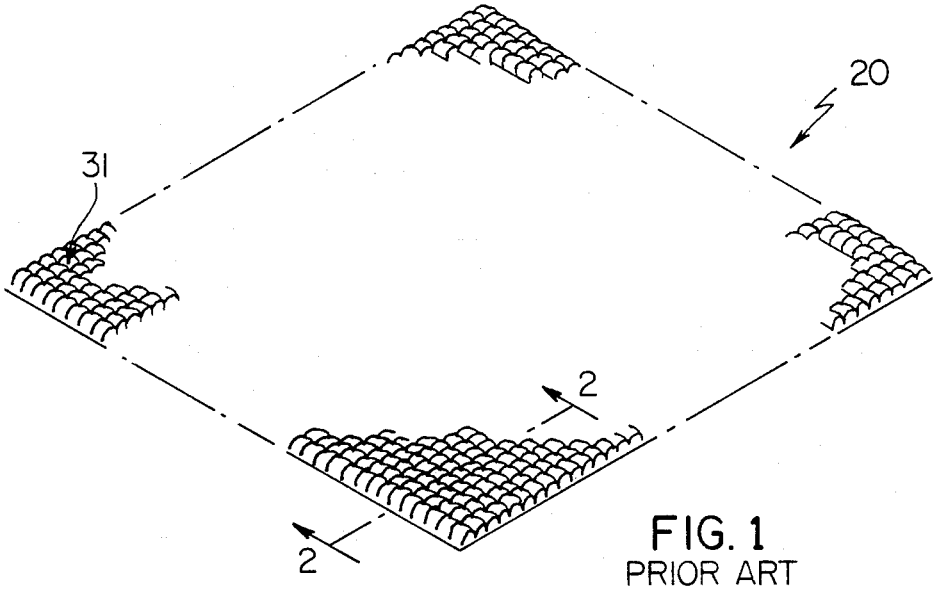
FIG. 1 PRIOR ART
FIG. 1 is an isometric view of a prior art terry-type cloth product.

While the various features of this invention are hereinafter illustrated and described as being particularly adapted to provide a terry-type cloth product which is shown in flat form such as a bedspread, towel, or the like, it is to be understood that the various features of this invention may be utilized singly or in various combinations thereof to provide a terry-type cloth product for clothing and other applications as desired.

Further, the drawings only illustrate certain arrangements, and combinations of pile yarns; however, it is to be understood that other uses, arrangements, and combinations of pile yarns may be utilized within the scope of the claims of this invention.

In addition, this invention is not to be limited to only the embodiments and uses illustrated in the drawings, because the drawings are merely utilized to illustrate primarily one of a wide variety of uses of this invention.

Figure 2:
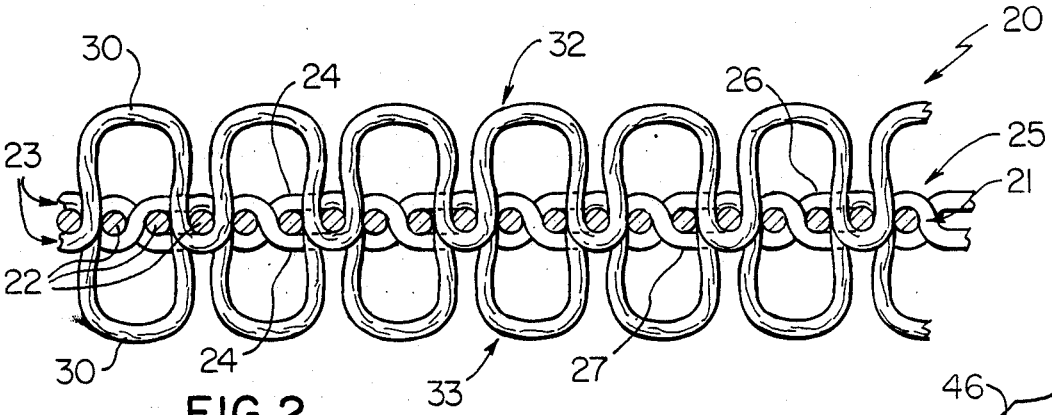
FIG. 2 PRIOR ART
FIG. 2 is an enlarged view taken essentially on the line 2—2 of FIG. 1 of the prior art terry-type cloth product of FIG. 1.

Reference is now made to FIGS. 1 and 2 of the drawings which illustrate one exemplary embodiment of a prior art terry-type cloth product of this invention which is designated generally by the reference numeral 20. The cloth product 20 comprises ground fill which is designated generally by the reference numeral 21 and such ground fill comprises a plurality of ground fill yarns which are disposed in parallel spaced apart relation and each is designated by the same reference numeral 22 with only a few of such ground fill yarns being so designated.

The product 20 also comprises ground warp which is designated generally by the reference numeral 23 and such ground warp consists of a plurality of ground warp yarns each designated by the same reference numeral 24 with only a representative few of such yarns being so designated. The ground fill 21 and ground warp 23 are interlaced to define what is referred to in the art as ground of the product 20 and such ground is designated generally by the reference numeral 25. The ground 25 has a top surface 26 and a bottom surface 27 and the product has pile warp 30 extending from the ground with the pile warp 30 comprising a plurality of sets of pile yarns indicated generally by the reference numeral 31 in FIG. 1 with each set of pile yarns having a plurality of pile yarns. In the prior art cloth product 20 any desired number of sets of pile yarns may be selected; however, it will be seen from FIG. 2 that the pile yarns of each set extend in a plurality of adjacent loops 32 above the top surface 26 and plurality of adjacent loops 33 beneath the bottom surface 27. It will be appreciated that in the prior art cloth product 20 the pile warp 30 extending above the top surface 26 is interlaced with the ground fill yarns 22 and always extends from the ground 25 above such top surface; and, the pile warp 30 extending beneath the bottom surface 27 is interlaced with the ground fill yarns 22 and always extends from the ground 25 beneath the bottom surface 27.

Figure 3A:
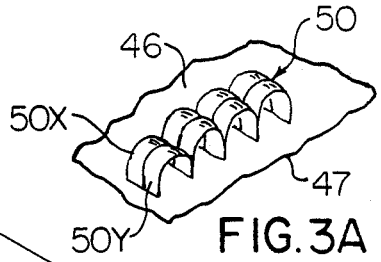
FIG. 3A is an enlarged fragmentary view showing adjacent loops of a typical pile yarn of FIG. 3 and showing that such typical yarn is made of a plurality of two strands.
Figure 3:
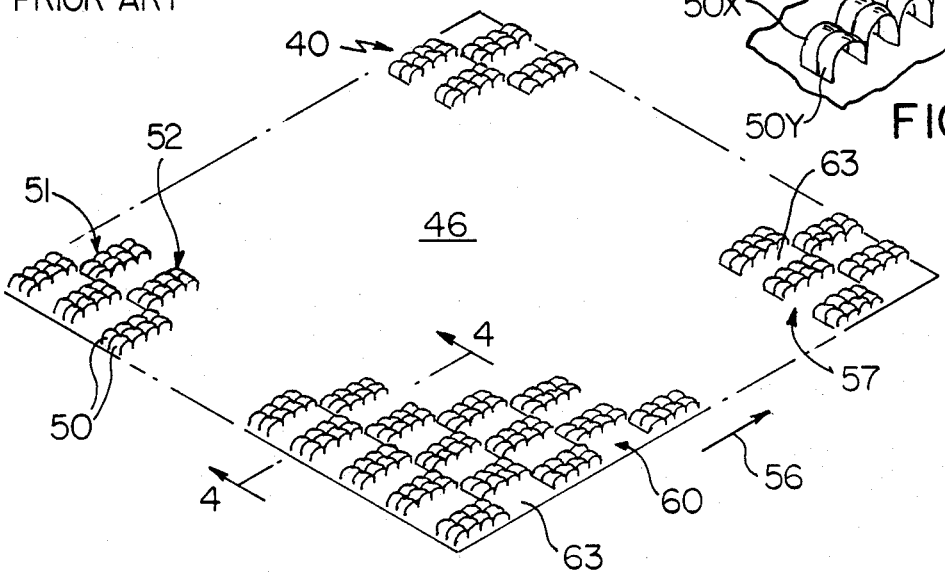
FIG. 3 is a view similar to FIG. 1 illustrating one exemplary embodiment of a new terry-type cloth product of this invention.

Having described the prior art terry-type cloth product 20 the disclosure will now proceed with a detailed description of the new terry-type cloth product of this invention which is designated generally by the reference numeral 40 and particular reference is now made to FIGS. 3 and 4 of the drawings in connection with this description.

As best seen in FIG. 4 the product 40 comprises ground fill designated generally by the reference numeral 41 and consisting of a plurality of parallel spaced apart ground fill yarns each designated by the same reference numeral 42 and with only a representative few of such yarns being so designated, and ground warp designated generally by the reference numeral 43 and consisting of a plurality of ground warp yarns 44 with only a representative few of such ground warp yarns being designated by the reference numeral 44. The ground fill 41 and ground warp 43 are interlaced to define ground, which is designated generally by the reference numeral 45, of the product 40; and, the ground 45 has a top surface 46 and a bottom surface 47.

The product 40 also has pile warp 50 which extends from the ground 45 and the pile warp comprises a plurality of sets, as shown at 51 in FIG. 3, of pile yarns 50 with each set of pile yarns having a plurality of pile yarns. The pile warp yarns 50 of each set extend in a plurality of adjacent loops 52 above the top surface 46 and then pass through the ground 45, as shown at 53 in FIG. 4, and extend in a plurality of adjacent loops 54 beneath the bottom surface 47. The pile yarns 50 of each set again pass upwardly through the ground 45 as shown at 55 and repeat in adjacent loops 52 above the top surface 46 and beneath the bottom surface 47 across a dimension, along the direction of the arrow 56 in FIGS. 3 and 4, of the product 40. As will be readily apparent from the drawings each immediately adjacent pair of sets of yarns is staggered as shown at 57 in FIG. 3, so as to produce a checkered pattern defined by sets 51 of pile yarns 50 and ground 45 on each of the top and bottom surfaces 46 and 47 respectively.

Only the checkered pattern provided on the top surface 46 is illustrated in FIG. 3; however, it will be readily apparent from this description and from the illustration of FIG. 4 of the drawings that a similar checkered pattern is formed and provided on the bottom surface 47. For simplicity and ease of presentation the checkered pattern on the bottom surface 47 has not been illustrated in the drawings. It will be understood that at locations where adjacent loops 52 extend above the top surface 46 similar loops do not extend beneath the bottom surface 47 as shown at 58 in FIG. 4, and likewise at locations where adjacent loops 52 do not extend above the top surface 46 as shown at 60 in FIG. 3 similar adjacent loops extend beneath the bottom surface 47 as shown at 61 in FIG. 4 for example.

The ground portion of each of the checkered patterns on each of the top and bottom surfaces 46 and 47 respectively has rectangular air spaces 63 associated therewith whereby such air spaces are also in a checkered pattern as will be readily apparent from FIG. 3 of the drawings. The air spaces 63 serve to improve the thermal insulating character of the cloth product 40. It will also be appreciated that each of the air spaces 63 associated with the top surface 46 has an inside boundary 64 defined by such top surface and each of the air spaces 63 associated with the bottom surface 47 has an inside boundary 65 defined by such bottom surface.

As seen in FIG. 4 of the drawings the ground 45 has a particular thickness 67 and each of the loops 52 and 54 has a bight 70 disposed remote from its associated surface either top surface 46 or bottom surface 47 by dimension 71 which is greater than the thickness 67. Preferably the dimension 71 is generally of the order of two times greater than the thickness 67 and may be as much as three to four times greater than the thickness 67 of the ground 45.

Referring again to FIGS. 3–4 of the drawings, it is seen that the pile yarns 50 of each set extend in the plurality of adjacent loops 52 above the top surface 46 and a plurality of adjacent loops 54 beneath the bottom surface 47 with each plurality of adjacent loops 52 and 54 being defined by four adjacent loops.

The pile yarns 50 of each set consist of a plurality of pile yarns and in the example of FIG. 3 of this invention a plurality of two pile yarns comprise the pile yarns of each set. However, it will also be appreciated that any desired number of pile yarns may be provided in each set.

As seen in FIG. 3A, each of the pile yarns 50 of the plurality of pile yarns of each set is comprised of a plurality of two side-by-side strands 50X and 50Y. However, it will be appreciated that each pile yarn 50 may be comprised of any desired number of strands which may be in side-by-side, twisted, or some other relation.

The product 40 has suitable borders defined by interwoven yarns and the borders of the product in the direction which is perpendicular to the dimension 56 is shown at 72 in FIG. 5; and, in essence, is comprised of portions of ground 45 with the pile warp being interwoven at the border portions of the product 40. Similarly, in a manner known in the art the pile warp in the cloth product at opposite ends of such product in the direction of the dimension 56 is suitably interwoven in a manner known in the art, to provide suitable borders in the product at opposite ends thereof along the dimension 56.

Other exemplary embodiments of the cloth product of this invention are illustrated in FIGS. 6, 7–8, and 9. The cloth products illustrated in FIGS. 6, 7–8 and 9 are very similar to the product 40. Therefore, such cloth products will be designated generally by the reference numerals 40A, 40B, and 40C respectively and representative parts of each product which are similar to corresponding parts of the product 40 will be designated in the drawings by the same reference numeral as in the product 40 whether or not such representative parts are mentioned in the specification (followed by the letter designation A, B, or C and not described again in detail). Only those component parts of each cloth product of FIGS. 6, 7–8, and 9 which are substantially different from corresponding parts of the product 40 will be designated by a new reference numeral and also followed by the associated letter designation and described in detail.

It will also be appreciated that the products 40A, 40B, and 40C may be utilized to define the same product or similar products as the product 40 including flat sheet-like products such as bedspreads, towels, and bibs as well as articles of clothing, and the like, in a similar manner as previously mentioned.

The cloth product 40A of FIG. 6 consists of a plurality of pile yarns 50A also arranged in sets in a similar manner as previously described and the plurality of pile yarns in each set consists of a plurality of four pile yarns (instead of two, as before) as shown at 74A, for example. In addition, each of the four pile yarns 50A of each set is comprised of a plurality of side-by-side strands 50X and 50Y as shown at 75A in FIG. 6A, for example. In the cloth product 40A each of the yarns 50A extends with four adjacent loops 52A above the top surface 46A and four adjacent loops 54A beneath the bottom surface in an alternating manner above and below the ground 45A in a similar manner as shown in FIG. 4 for the cloth product 40.

Figure 7:
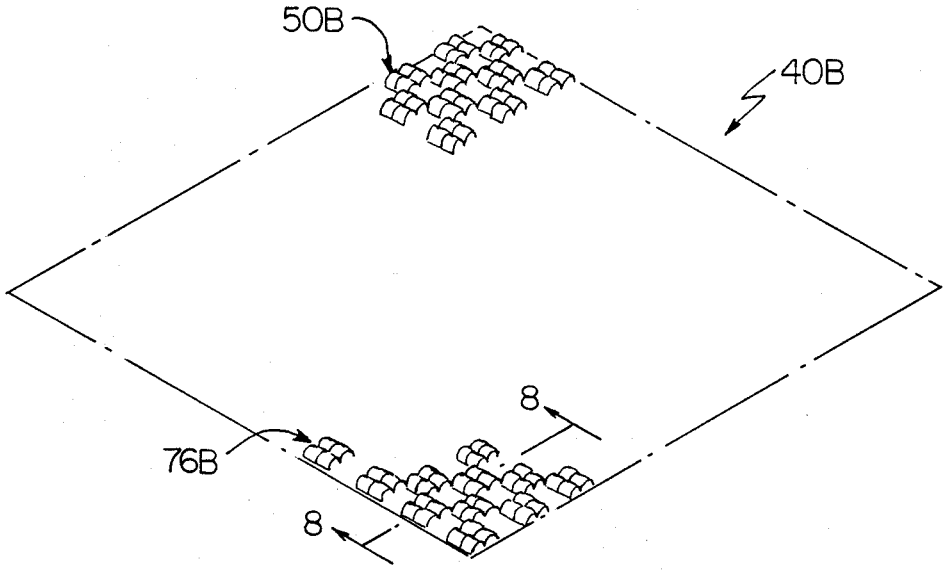
FIG. 7 is a view similar to FIG. 3 illustrating still another exemplary embodiment of the cloth product of this invention.
Figure 8:
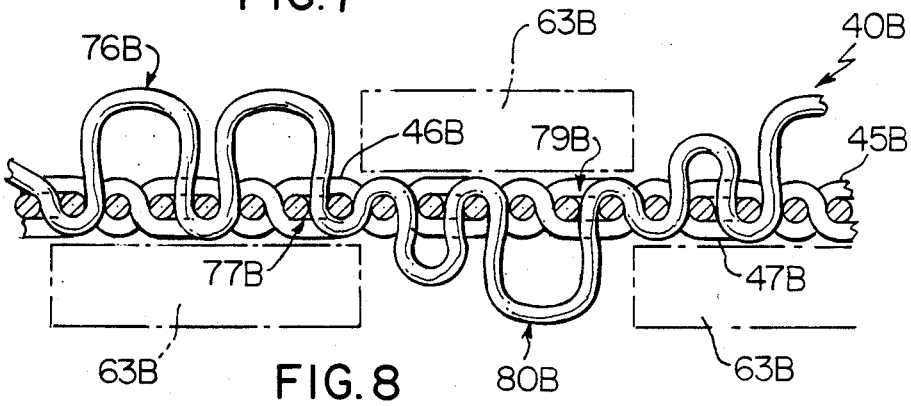
FIG. 8 is a view similar to FIG. 4 taken essentially on the line 8—8 of FIG. 7.

The cloth product 40B of FIGS. 7 and 8 comprises a plurality of sets of pile yarns 50B with the pile yarns of each set extending in a plurality of two adjacent loops defined by two adjacent loops 76B above the top surface 46B and then passing through the ground 45B as shown at 77B and extending in a plurality of two adjacent loops 80B beneath the bottom surface 47B of the ground with the pile yarns of each set again passing through the ground as shown at 79B and repeating in adjacent loops above the top surface and beneath the bottom surface in a similar manner as previously described for the product 40.

As previously described each immediately adjacent pair of sets of yarns is staggered so as to provide a checkered pattern defined by sets of pile yarns and ground on each of said top and bottom surfaces 46B and 47B respectively. In addition, each of the checkered patterns has rectangular air spaces 63B associated therewith which are also in a checkered pattern and for the same reasons previously described.

Each of the pile yarns 50A of FIG. 6 may also be comprised of a plurality of strands and which may be a plurality of two side-by-side strands as previously described, or strands disposed in some other manner.

Figure 9:
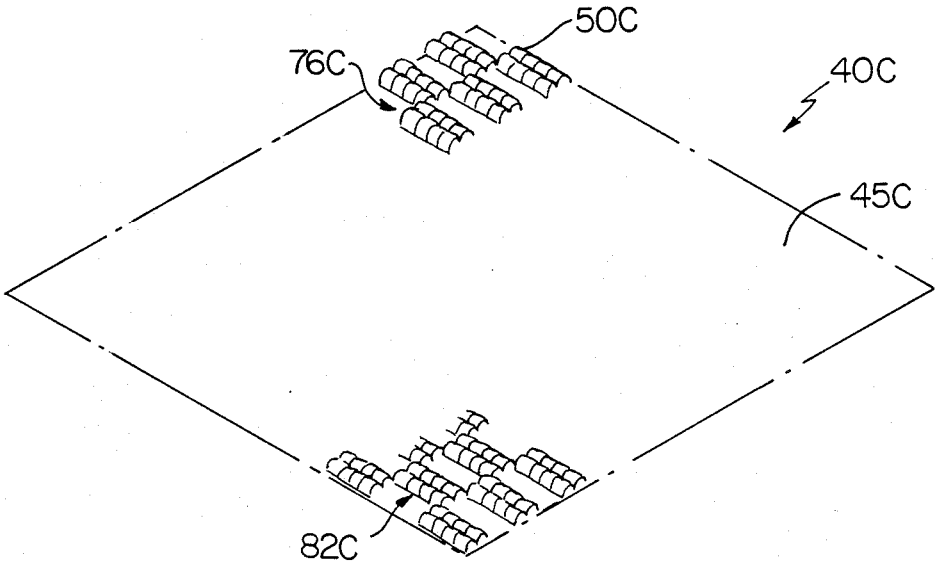
FIG. 9 is a view similar to FIG. 6 illustrating yet another exemplary embodiment of the cloth product of this invention.

The cloth product 40C of FIG. 9 is very similar to the cloth product 40B and once again, as in product 40B, the pile yarns 50C of each set extend in a plurality of two adjacent loops 76C above grounds 45C and then in a plurality of two adjacent loops 80C beneath ground 45C in a similar manner as shown in FIG. 8 for the cloth product 40B. The pile yarns in each set of cloth product 40C instead of consisting of two pile yarns consist of four pile yarns as shown at 82C in FIG. 9.

The yarns defining the ground fill, ground warp, and pile warp of the cloth product of this invention (and it is to be understood that any reference to cloth product means cloth product 40, 40A, 40B and 40C) may be made of any suitable material including yarns made of natural or synthetic material. Preferably all of the yarns are made of cotton, however, such yarns may be made of blends of cotton and polyester as is known in the art. Further, depending upon the desired characteristic of the product the ground fill and ground warp may be selected of appropriate materials and the pile warp may be selected of the same or different materials, likewise any combination of yarns may be utilized to define the ground fill, ground warp, and pile warp as desired.

The product of this invention is superior over regular terry cloth and is superior over cloth products made utilizing a leno weave often utilized for bedspreads and the like where a thermal insulating property is desired. In addition, it will be appreciated that the cloth product of this invention lends itself to providing a product which is aesthetically pleasing, is functional for optimum durability, has higher insulating value than other traditional products such as leno weave, or the like. In addition, it will be appreciated that the checkered pattern provided in the product of this invention, and previously described, lends itself to utilizing different color yarns and even with the same color yarns provides a highlighting effect due to the construction and arrangement of the pile yarns with respect to the ground.

A ratio of the dimension of the pile warp with respect to the thickness of the ground was previously set forth. It will be appreciated that if the pile warp is such that each loop is comparatively low there is a small amount of air trapped (dead air space) in the rectangular air spaces which are disposed in the checkered patterns. If the loops of the pile warp are too high then the insulating value diminishes after the dimension 71 is more than four times greater than the thickness 67 of the ground 45 of the product 40, for example. If the dimension 71 is too small when compared to the thickness of ground 45, less than ½ the thickness 45, then the insulating value is also diminished.

To give a comparison, if the product 40, 40A, 40B, or 40C were considered to have a thermal insulating "Clo" value 1.00, then traditional weaves or cloth products having traditional weaves which were known prior to this invention have thermal insulating "Clo" values of the order of 0.5 to 0.85. Thus, it is clear that the cloth product of this invention provides optimum thermal insulation in addition to the other qualities previously mentioned.

In this disclosure of the invention use has been made of terms such as top surface, bottom surface, and the like. However, it is to be understood that these terms are used to describe the items as illustrated in the drawings and such terms are not to be considered limiting in any way.

Thus, it is seen from the above description that this invention provides a new cloth product which is considered superior to cloth products presently available on the market. In addition, this invention provides a new method of making such a cloth product.

While the forms and methods of this invention now preferred have been illustrated and described as required by the Patent Statute it is to be understood that other forms and method steps can be utilized and still fall within the scope of the appended claims wherein each claim sets forth therein what is believed to be known in the art prior to this invention in that portion of each claim that is presented before the term "the improvement" and sets forth what is believed to be new in the art according to this invention in that portion of each claim that is presented after the term "the improvement" whereby it is believed that each claim sets forth a novel, useful, and unobvious invention within the purview of the Patent Statute.

What is claimed is:

1. In a terry-type cloth product comprising, ground fill and ground warp interlaced to define ground of said product, said ground having a top surface and a bottom surface, and pile warp extending from said ground, said pile warp comprising a plurality of sets of pile yarns with each set of pile yarns having a plurality of pile yarns, the improvement in which said pile yarns of each set extend in a plurality of adjacent loops above said top surface and then pass through said ground and extend in a plurality of adjacent loops beneath said bottom surface, said pile yarns of each set again pass through said ground and repeat in adjacent loops above said top surface and beneath said bottom surface across a dimension of said product, and each immediately adjacent pair of sets of yarns is staggered so as to provide a checkered pattern defined by sets of pile yarns and ground on each of said top and bottom surfaces.

2. A cloth product as set forth in claim 1 in which the ground portion of each of said checkered patterns has rectangular air spaces associated therewith whereby said air spaces are also in a checkered pattern, said air spaces serving to improve the thermal insulating character of said cloth product.

3. A cloth product as set forth in claim 2 in which each of said air spaces associated with said top surface has an inside boundary defined thereby and each of said air spaces associated with said bottom surface has an inside boundary defined thereby.

4. A cloth product as set forth in claim 2 in which said ground has a particular thickness and each of said loops has a bight disposed remote from its associated surface by a dimension which is greater than said thickness.

5. A cloth product as set forth in claim 2 in which said ground has a particular thickness and each of said loops has a bight disposed remote from its associated surface by a dimension which is generally of the order of two times greater than the thickness of said ground.

6. A cloth product as set forth in claim 2 in which said pile yarns of each set extend in said plurality of adjacent loops defined by four adjacent loops.

7. A cloth product as set forth in claim 6 in which said plurality of pile yarns of each set consist of a plurality of two pile yarns in each set.

8. A cloth product as set forth in claim 7 in which each of said pile yarns comprises a plurality of side-by-side strands.

9. A cloth product as set forth in claim 6 in which said plurality of pile yarns of each set consists of a plurality of four pile yarns.

10. A cloth product as set forth in claim 9 in which each of said pile yarns comprises a plurality of two side-by-side strands.

11. A cloth product as set forth in claim 2 in which each of said pile yarns is made of cotton.

12. A cloth product as set forth in claim 2 in which each of said pile yarns is made of a blend of cotton and polyester.

13. A cloth product as set forth in claim 2 in which said pile yarns of each set extend in said plurality of adjacent loops defined by two adjacent loops.

14. A cloth product as set forth in claim 13 in which said pile yarns of each set consist of four pile yarns.

15. A cloth product as set forth in claim 13 in which each of said pile yarns comprises a plurality of side-by-side strands.

16. In a terry-type bedspread which provides thermal insulation, said bedspread comprising, ground fill and ground warp interlaced to define ground of said bedspread, said ground having a top surface and a bottom surface, and pile warp extending from said ground, said pile warp comprising a plurality of sets of pile yarns with each set of pile yarns having a plurality of pile yarns, the improvement in which said pile yarns of each set extend in a plurality of adjacent loops above said top surface and then pass through said ground and extend in a plurality of adjacent loops beneath said bottom surface, said pile yarns of each set again pass through said ground and repeat in adjacent loops above said top surface and beneath said bottom surface across a dimension of said bedspread and each immediately adjacent pair of sets of yarns is staggered so as to provide a checkered pattern defined by sets of pile yarns and ground on each of said top and bottom surfaces.

17. A bedspread as set forth in claim 16 in which the ground portion of each of said checkered patterns has rectangular air spaces associated therewith whereby said air spaces are also in a checkered pattern, said air spaces serving to improve said thermal insulation of said cloth product.

18. A cloth product as set forth in claim 17 in which each of said air spaces associated with said top surface has an inside boundary defined thereby and each of said air spaces associated with said bottom surface has an inside boundary defined thereby.

19. In a method of making a terry-type cloth product comprising the steps of, interlacing ground fill and ground warp to define ground of said product, said ground having a top surface and a bottom surface, interlacing pile warp from said ground, said step of interlacing pile warp comprising interlacing a plurality of sets of pile yarns with each set of pile yarns having a plurality of pile yarns, the improvement in which said step of interlacing pile yarns comprises interlacing said pile yarns so that said pile yarns of each set extend in a plurality of adjacent loops above said top surface and then pass through said ground and extend in a plurality of adjacent loops beneath said bottom surface, said pile yarns of each set again pass through said ground and repeat in adjacent loops above said top surface and beneath said bottom surface across a dimension of said product, and each immediately adjacent pair of sets of yarns is staggered so as to provide a checkered pattern defined by sets of pile yarns and ground on each of said top and bottom surfaces.

20. A method as set forth in claim 19 in which said step of interlacing said pile yarns results in the ground portion of each of said checkered patterns having rectangular air spaces associated therewith whereby said air spaces are also in a checkered pattern, said air spaces serving to improve the thermal insulating character of said cloth product.

* * * * *